US005093061A

United States Patent [19]

Bromley et al.

[11] Patent Number: 5,093,061

[45] Date of Patent: Mar. 3, 1992

[54] DEEP DYEING CONJUGATE YARN PROCESSES

[75] Inventors: James E. Bromley; Jing-peir Yu, both of Pensacola, Fla.

[73] Assignee: Monsanto, St. Louis, Mo.

[21] Appl. No.: 182,669

[22] Filed: Apr. 18, 1988

Related U.S. Application Data

[60] Division of Ser. No. 012,528, Jan. 27, 1987, abandoned, and a continuation of Ser. No. 683,833, Dec. 19, 1984, abandoned, and a continuation-in-part of Ser. No. 565,924, Dec. 27, 1983, abandoned, and a continuation-in-part of Ser. No. 565,427, Dec. 27, 1983, abandoned, which is a continuation-in-part of Ser. No. 355,958, Mar. 8, 1982, abandoned.

[51] Int. Cl.[5] ..... D01D 5/32

[52] U.S. Cl. ..... 264/171; 264/210.8; 264/DIG. 26

[58] Field of Search ..... 264/DIG. 26, 171, 210.8

[56] References Cited

U.S. PATENT DOCUMENTS

| | | | |
|---|---|---|---|
| 2,783,609 | 3/1957 | Breen | 57/140 |
| 3,117,362 | 1/1964 | Breen | 57/140 |
| 3,127,729 | 4/1964 | Head | 57/34 |
| 3,181,224 | 5/1965 | Tanner | 28/72 |
| 3,350,488 | 10/1967 | Breen | 264/171 |
| 3,418,200 | 12/1968 | Tanner | 161/177 |
| 3,623,939 | 11/1971 | Ono et al. | 264/168 |
| 3,912,784 | 11/1975 | Nishida | 264/103 |
| 3,916,611 | 11/1975 | Matsui et al. | 264/171 |
| 3,966,865 | 6/1976 | Nishida et al. | 264/147 |
| 4,051,287 | 9/1977 | Hazashi et al. | 428/91 |
| 4,073,988 | 2/1978 | Nishida et al. | 428/91 |
| 4,093,147 | 6/1978 | Bromley et al. | 242/159 |
| 4,109,038 | 8/1978 | Hazashi et al. | 428/91 |
| 4,330,591 | 5/1982 | Blackmon et al. | 428/369 |
| 4,332,757 | 6/1982 | Blackmor et al. | 264/171 |
| 4,357,290 | 11/1982 | Yu | 264/171 |

FOREIGN PATENT DOCUMENTS 0013186 7/1980 European Pat. Off. .

*Primary Examiner*—Hubert C. Lorin
*Attorney, Agent, or Firm*—Thomas N. Wallin

[57] ABSTRACT

Deep-dyeing conjugate filaments are melt-spun by merging molten sub-streams of incompatible polymers to form combined streams, then quenching the combined streams to form the conjugate filaments. The filaments are preferably cold drawn prior to winding, increasing the bulk level in a fabric containing the filaments and increasing the dye stability of the filaments. When the sub-streams are merged outside of the spinneret, the filaments split into the sub-filaments upon exposure to boiling water while under no tension. When the sub-streams merge within the spinneret, the filament is not readily split into sub-filaments, but forms a helically crimped filament.

22 Claims, 3 Drawing Sheets

DEEP DYEING CONJUGATE YARN PROCESSES

This is a division, of application Ser. No. 012,528, filed Jan. 27, 1987 (now abandoned), and a continuation of application Ser. No. 683,833 filed Dec. 19, 1984, (now abandoned) and a continuation-in-part of application Ser. No. 565,424, filed Dec. 27, 1983 (now abandoned) and of application Ser. No. 565,427, filed Dec. 27, 1983 (now abandoned) which in turn is a continuation-in-part of application Ser. No. 355,958, filed Mar. 8, 1982 (now abandoned).

The invention relates to the art of melt-spinning conjugate filaments. More particularly it relates to more efficiently spinning filaments which have improved dyeing and other properties.

It is known to spin splittable conjugate filaments by merging side-by-side a plurality of sub-streams of incompatible polymers into a combined orifice in a spinneret thus producing a conjugated stream within the spinneret, the combined stream flowing along the spinneret capillary for several thousandths of an inch, e.g., 0.012 inch (0.305 mm.). The combined stream is then quenched to form a spun conjugate filament. The spun conjugate filament is then typically hot drawn or draw-textured. The resulting drawn conjugate filament can be vigorously treated with chemicals or mechanically worked, or both, so as to split the conjugate filament into sub-filaments, each of which is composed of one of the incompatible polymers. Typical references in this area are Tanner U.S. Pat. No. 3,181,224, Tanner U.S. Pat. No. 3,418,200, and Nishida U.S. Pat. No. 4,073,988. The required vigorusness of treatment of the filament (or of a fabric containing the filament) is disadvantageous because of the added cost of the step of working the fabric, and because of possible damage to the fabric. If chemical treatment is involved, there is loss of fiber polymer in some cases and the added problem of disposal and handling of the chemicals involved so as to avoid environmental pollution.

Conjugate filaments which have latent crimp and do not readily split into sub-filaments are likewise known and have been in limited commercial use for certain applications. Such filaments or yarns containing such filaments are typically made by melt-spinning dissimilar polymers as side-by-side conjugate filaments at fairly low winding speeds of the order of 1,500 meters per minute (MPM) or less. The filaments wound on the spin package are then hot drawn (or drawn and textured) in one or more separate operations to produce filaments with helical crimp. One such prior art approach is disclosed in Tanner U.S. Pat. No. 3,117,906. The relatively slow speeds and multiple processing steps are time consuming and relatively expensive, and the product quality is frequently undesirable in such properties as denier uniformity and dyeability.

In each of the above known processes the hot drawing step reduces the dyeability of the filament.

According to the invention, these and other disadvantages in the prior art are avoided by novel modifications of the spinning process providing improved yarns with increased productivity, improved dyeability, and reduced manufacturing costs.

According to a first principal aspect of the invention relating to splittable filaments, there is provided a process for melt-spinning an easily splittable deep-dyeing substantially constant denier conjugate filament from first and second incompatible polymers, the filament being self-texturing in fabric form, comprising generating a first molten sub-stream of the first polymer and a second molten sub-stream of the second polymer converging at substantially the same speed to merge side-by-side as a combined stream below the face of a spinneret, quenching the combined stream to form a conjugate filament comprising a first sub-filament of the first polymer lightly conjugated side-by-side with a second sub-filament of the second polymer, withdrawing the filament from the combined stream at a predetermined spinning speed, and winding the filament at a given winding speed on a bobbin, the polymers and the spinning speed being selected such that the filament splits substantially completely into the sub-filaments upon exposure to boiling water while under no tension.

According to a second principal aspect of the invention relating to splittable filaments, there is provided a yarn package having wound thereon a substantially constant denier deep-dyeing conjugate filament comprising thermoplastic sub-filaments temporarily adhering side-by-side along the length of the conjugate filament, the adhesion between the sub-filaments being sufficiently light that the conjugate filament splits substantially completely into the sub-filaments upon exposure to boiling water while under no tension.

According to a third principal aspect of the invention relating to splittable filaments, there is provided a process for melt-spinning an easily splittable deep-dyeing variable denier conjugate filament from first and second incompatible polymers, the filament being self-texturing in fabric form, comprising generating a first molten sub-stream of the first polymer and a second molten sub-stream of the second polymer converging at substantially different speeds to merge side-by-side as a combined stream below the face of a spinneret whereby an oscillation of the sub-streams occurs just below the face of the spinneret, quenching the combined stream to form a conjugate filament comprising a first sub-filament of the first polymer lightly conjugated side-by-side with a second sub-filament of the second polymer, withdrawing the filament from the combined stream at a predetermined spinning speed, and winding the filament at a given winding speed on a bobbin, the polymers and the spinning speed being selected such that the filament splits substantially completely into the sub-filaments upon exposure to boiling water while under no tension.

According to a fourth principal aspect of the invention relating to splittable filaments, there is provided a yarn package having wound thereon a substantially variable denier deep-dyeing conjugte filament comprising thermoplastic sub-filaments temporarily adhering side-by-side along the length of the conjugate filament, the adhesion between the sub-filaments being sufficiently light that the conjugate filament splits substantially completely into the sub-filaments upon exposure to boiling water while under no tension.

According to a fifth principal aspect of the invention relating to filaments which do not readily split, there is provided a process for melt-spinning a deep-dyeing conjugate filament having latent helical crimp from first and second dissimilar polymers, comprising generating a first molten sub-stream of the first polymer and a second molten sub-stream of the second polymer converging to merge side-by-side as a combined stream before extrusion from the face of a spinneret, quenching the combined stream to form a conjugate filament comprising a first sub-filament of the first polymer conjugated side-by-side with a second sub-filament of the second polymer, withdrawing the filament from the combined stream at a predetermined spinning speed above 2200 MPM, and winding the filament on a bobbin at a winding speed above 3000 MPM, the polymers, the spinning speed and the winding speed being selected such that the filament wound on the bobbin has a shrinkage greater than 10%.

In each of the above principal aspects, the first sub-stream is preferably a polyamide (preferably nylon 66) and the second sub-stream is preferably a polyester (preferably poly(ethylene terephthalate)). The spinning speed is advantageously at least 2200 MPM and the filament shrinkage is preferably at least 10% (advantageously at least 20%). Preferably the filament is drawn at a temperature less than 100° C. prior to being wound on the bobbin. The winding speed and the amount by which the filament is drawn are advantageously selected such that the filament wound on the bobbin has an elongation less than 70%, with best results being obtained when the winding speed and the amount by which the filament is drawn are selected such that the filament wound on the bobbin has an elongation less than 50%.

Other aspects will in part appear hereinafter and will in part be obvious from the following detailed description taken together with the accompanying drawing, wherein.

READILY SPLITTABLE FILAMENTS

Figure 1:
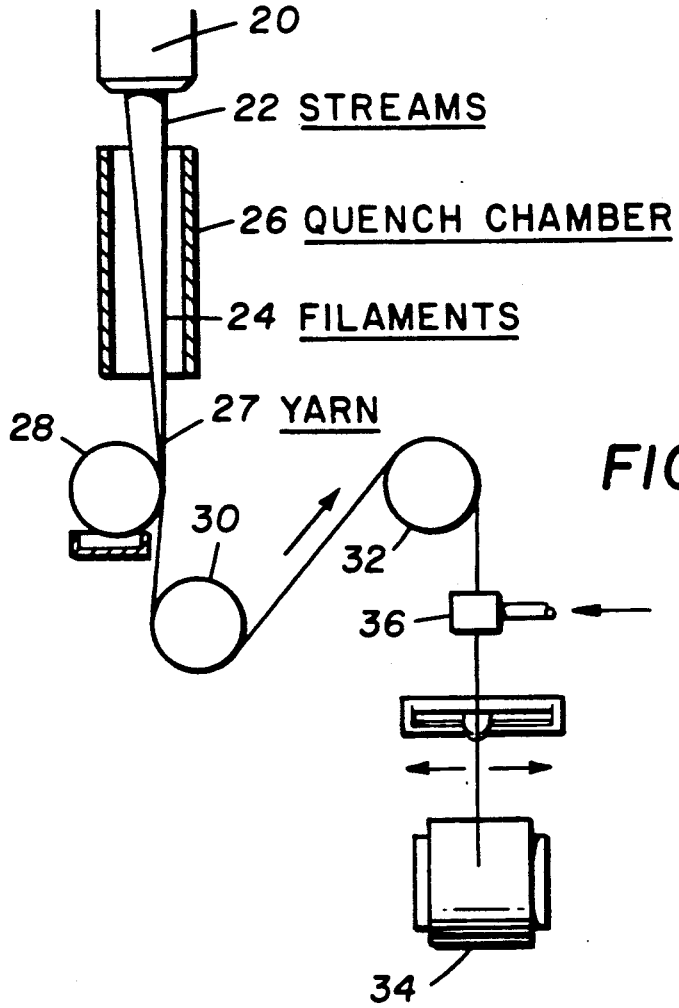
FIG. 1 is a vertical elevational schematic of a spinning apparatus usable according to the invention.

As shown in FIGS. 1, 3, 4, and 6, first and second polymers are conjugately melt spun as molten streams from spinneret 20. Molten streams 22 are quenched into filaments 24 by transverse quench air in quench chamber 26. The filaments are converged into yarn 27, with conventional spin finish applied at 28, the filaments being withdrawn from the molten streams at a spinning speed determined by unheated godet 30. The yarn next passes over unheated godet 32 prior to being wound onto a package by winder 34. Godet 32 preferably is driven at least slightly faster than godet 30, and it is particularly preferred that godet 32 be driven at a significantly higher speed so as to apply a draw to the filaments. The filaments may be entangled by conventional tangle chamber 36. While godets are preferred, godetless spinning is in accord with certain aspects of the invention, in which case the spinning speed will be determined by the winder. It is preferred that the godets be unheated if godets are used.

Figure 3:
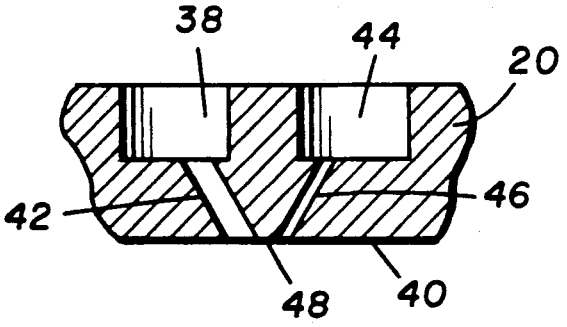
FIG. 3 is a vertical sectional view of a spinneret showing a combined orifice according to certain aspects of the invention for making an easily splittable filament.
Figure 4:
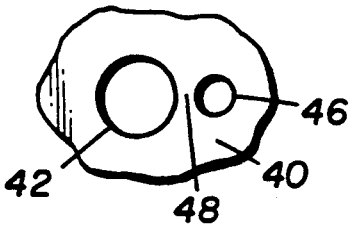
FIG. 4 is a bottom plan view of the FIG. 3 spinneret.
Figure 5:
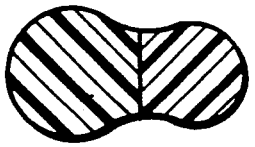
FIG. 5 is a sectional view of an easily splittable filament according to the invention.
Figure 6:
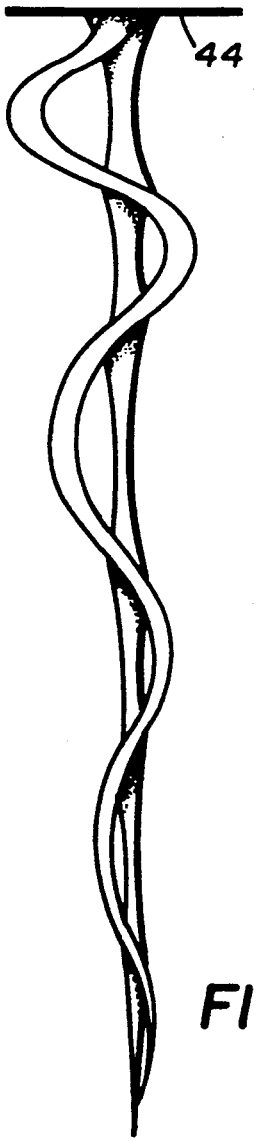
FIG. 6 is a schematic elevation view showing the oscillation of the molten streams just below the face of the spinneret which occurs according to certain aspects of the invention.
Figure 7:
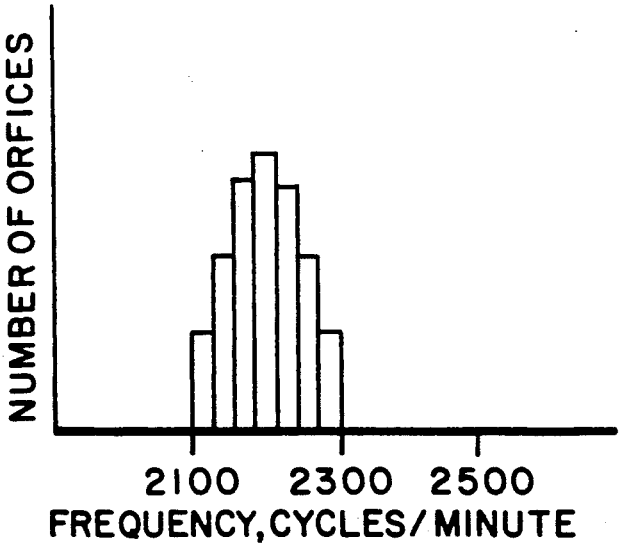
FIG. 7 is a graph showing qualitatively the oscillation frequencies of a plurality of combined orifices in the same spinneret.

As shown in FIGS. 3 and 4, the preferred spinneret construction has counterbores 38 and 40 formed in the upper surface of spinneret 20. Capillary 42 extends from the bottom of counterbore 38 to bottom face 44 of spinneret 20, while capillary 46 extends from the bottom of counterbore 40 to face 44. Capillaries 42 and 46 are separated by land 48 on face 44, and their axes form an included angle so that the molten polymer streams metered therethrough converge to merge side-by-side below spinneret face 44 as a combined stream. The combined stream is conventionally quenched (as by transversely moving air) into a conjugate filament which is withdrawn from the combined stream at the predetermined spinning speed set by godet 30. The spinning speed is much higher than the speed of any of the molten sub-streams, so that the combined stream is attenuated substantially as it is being quenched. Since the pair of capillaries 42 and 46 cooperate to form a single combined stream, and ultimately a single filament, they are collectively referred to herein as a combined orifice.

EXAMPLE I

This is an example wherein the yarn has constant denier. A spinneret is provided containing 18 combined orifices, each combined orifice being as disclosed in this example. Thus the spinneret produces 18 conjugate filaments. Within each combined orifice, capillaries 42 and 46 have diameters of 0.009 inch (0.23 mm.) and are 0.1 inch long (2.54 mm.). The axis of each capillary is inclined 12° from the vertical, and thus the axes within a combined orifice form an included angle of 24°. Land 48 separating capillaries 42 and 46 on face 44 has a width of 0.017 inch (0.43 mm.).

While this paragraph for simplicity refers only to spinning of a single filament from a single combined orifice, it will be understood that the same description applies to each of the other combined orifices in the spinneret. Molten nylon 66 polymer of normal molecular weight for apparel end use is metered and extruded as a first sub-stream through capillary 42, while molten poly(ethylene terephthalate) polymer of normal molecular weight for apparel end use is metered through capillary 46 to form a second sub-stream. The polymer melt temperatures are 285° C. The resulting combined stream is conventionally quenched into a conjugate filament by transversely directed air having an average speed of about 15–20 meters per minute, and the filament is withdrawn from the combined stream at a spinning speed of 3795 meters per minute (MPM). The polymer metering rates are selected such that equal volumes of polymer are extruded through capillaries 42 and 46 per unit of time, and such that the conjugate filament has a denier of 3.87. A conventional spin-finish is applied prior to winding at normal winding tension of about 0.1 gram per denier.

The multifilament conjugate yarn thus produced according to the invention comprises thermoplastic (nylon and polyester) sub-filaments temporarily adhering side-by-side along the length of the conjugate filaments. The adhesion between sub-filaments is sufficient that the filament (or a yarn comprising a plurality of such filaments) can be handled normally in such operations as texturing, knitting or weaving without difficulty, yet is sufficiently light or weak as to readily be overcome when the conjugate filament is exposed to boiling water, as in the normal scouring and dyeing operations employed in processing of fabrics. Under such conditions, the conjugate filament spontaneously and substantially completely splits into its constituent sub-filaments, thus avoiding the necessity for vigorously working the fabric to achieve splitting as is necessary with prior art splittable conjugate filaments. Ordinarily no added step of working of the fabric is necessary with filaments and yarns according to the present invention.

The yarn is woven as filling across a conventional warp, then conventionally scoured and dyed at the boil. The filling filaments split substantially completely into their constituent sub-filaments spontaneously upon contact with the boiling water with the PET sub-filaments shrinking most and forcing the nylon sub-filaments to protrude from the surface of the fabric in loops or arches. The fabric dyes more deeply than fabrics made from yarns which have been hot drawn.

Figure 2:
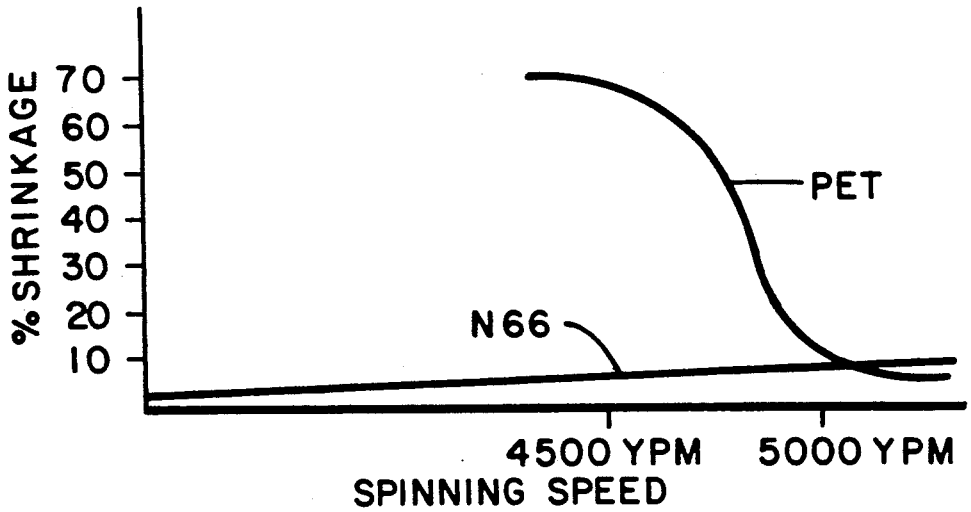
FIG. 2 is a graph qualitatively showing how the shrinkage of PET and nylon 66 vary with spinning speed.

A possible partial explanation for the unusual behavior of the yarns of the invention may be had with reference to FIG. 2 of the drawing. As generally shown therein, the shrinkage of a 100% PET yarn falls rapidly from very high values of about 50–70% at intermediate spinning speeds of about 3000 MPM to values of about 5% over a fairly narrow range of somewhat higher spinning speeds. The location of the narrow range varies somewhat with filament denier and with capillary diameter (jet stretch), but can be readily be located for a given capillary and filament denier by spinning at different spinning speeds. The shrinkage of nylon 66 does not exhibit such behavior but gradually increases to about 5% over this spinning speed range.

A conjugate filament of PET and nylon 66 spun at, for example, 4500 YPM will have a shrinkage somewhere between the values illustrated in FIG. 2 for PET and nylon 66 spun at this spinning speed. Yarns according to the invention may be made to be self-texturing in fabric form by selection of the spinning speed such that the PET sub-filaments have substantially higher shrinkage than the nylon 66 sub-filaments, as in the Example I yarn above. When such yarns are put in fabric form, then subjected to the customary scouring and dyeing operations, the filaments split into their constituent subfilaments, with the PET subfilaments then shrinking substantially more than the nylon subfilaments. This forces the nylon subfilaments to the surface of the fabric in protruding arches or loops, giving texture to the fabric. When the filaments have substantially constant denier as in Examples I and II herein, best self-texturing effects are obtained when the yarn on the bobbin has a shrinkage of at least 10%, preferably at least 20%.

Additional runs are made at different spinning speeds with the polymer metering rates adjusted to provide about 40 yarn denier, with results as follows.

TABLE 1

| Item | Godet 30 MPM | Godet 32 MPM | Elongation, % | Shrinkage, % |
|---|---|---|---|---|
| 1 | 3700 | 3700 | 94 | 48 |
| 2 | 4000 | 4000 | 86 | 35 |
| 3 | 4250 | 4250 | 75 | 24 |
| 4 | 4500 | 4500 | 73 | 9 |

The resulting yarns are woven as filling across conventional warps, with the resulting fabrics conventionally scoured and dyed at the boil. The filaments split substantially completely into the subfilaments and provide pleasing texture to the fabrics. However, the fabric from Item 4 has noticeably less texture than the fabrics from the other items.

EXAMPLE II

A series of runs are made using the same spinneret and polymers. The polymer metering rates are selected to produce about 40 yarn denier (about 2.2 denier per filament) while maintaining equal volumes of nylon and polyester. In each run, the actual winding speed is slightly lower than the speed of godet 32 in order to adjust the winding tension to about 0.1 gram per denier. Godet speeds and yarn properties are as set forth in Table 2.

TABLE 2

| Item | Godet 32, MPM | Godet 30, MPM | Elongation, % | Shrinkage, % |
|---|---|---|---|---|
| 1 | 4000 | 3600 | 76 | 53 |
| 2 | 4000 | 3000 | 74 | 61 |
| 3 | 4500 | 3600 | 66 | 53 |
| 4 | 4500 | 3400 | 63 | 57 |
| 5 | 4500 | 3200 | 58 | 60 |
| 6 | 4500 | 3000 | 58 | 62 |
| 7 | 5000 | 3600 | 48 | 51 |
| 8 | 5000 | 3400 | 49 | 54 |
| 9 | 5000 | 3200 | 49 | 55 |
| 10 | 5000 | 3000 | 45 | 56 |

The yarns of Table 2 are superior to that of Example I above, particularly in terms of dye-fastness of the nylon component with respect to disperse dyes and fabric stability. The small amount of in-line draw prior to winding in conjunction with high speed spinning is highly desirable in this regard. Among the Table 2 yarns, items 5 and 6 are more desirable than items 1–4, while items 7–10 are still further improved.

Superior results are obtained when a small amount of in-line draw is applied as in this example. It is believed that the more viscous PET sub-stream bears most of the stress of the high speed spinning, preventing the nylon sub-stream from receiving sufficient stress for proper orientation of the molecules if the solidified filament is not drawn prior to winding. After the filament has solidified, however, a small amount of draw applied before winding orients the nylon enough for dye-fastness.

If the spinning speed were sufficiently high that the yarn would have a shrinkage lower than desired in the absence of in-line draw, a small amount of cold draw orients the nylon and increases the PET shrinkage while not greatly affecting that of the nylon, thus providing the large shrinkage difference between the nylon and polyester components necessary for the splitting and self-texturing effect in fabric form. This may be seen by comparing items 2 and 4 in Table 1 with items 1–6 in Table 2.

EXAMPLE III

In contrast to the constant denier filaments produced in Examples I and II, a variable denier filament is readily produced by merging sub-streams extruded at substantially different speeds, producing an oscillation of the sub-streams just below the spinneret. This is preferably done by use of the FIGS. 3 and 4 type of combined orifice. The axes of capillaries 42 and 46 are each inclined 4° from the vertical. The axes thus form an included angle of 8°, and capillaries 42 and 46 are separated by land 48 on face 44. Capillary 42 has a diameter of 0.009 inch (0.23 mm.) and a length of 0.032 inch (0.81 mm.) while capillary 46 has a diameter of 0.016 inch (0.41 mm.) and a length of 0.146 inch (3.71 mm.). Land 48 has a width of 0.004 inch (0.1 mm.).

The same polymers are used as in Example I above, and the spinneret contains 18 combined orifice as described in the preceding paragraph. The polymer temperatures are each 282° C., with the polyester being extruded through capillaries 42 and the nylon through capillaries 46. The metering rates are selected such that the polyester/nylon ratio is 60/40 by volume, and the resulting 18 filament yarn has a total denier of 41.1. The spinning speed is 3658 MPM and the molten streams are quenched and have finish applied prior to winding, as in Example I.

The yarn is woven as filling across a conventional warp, then conventionally scoured and dyed at the boil. The filling filaments split substantially completely into their constituent sub-filaments spontaneously upon contact with the boiling water and provide fabric texture, as do the filaments in Example I above. Again, the polyester sub-filament has the higher shrinkage, forcing the nylon sub-filaments to the surface of the yarn. Yarns according to this example give in fabric form various novelty effects not available with the Example I yarn. As with the Example II yarn above, an in-line draw (prior to winding) increases the texturing effect and improves the dye stability of the nylon sub-filaments to disperse dyes.

The precise reason for the unexpected increased ease of splitting of the filaments of the above examples as compared to prior art splittable filaments is unknown, but is inherent in spinnerets wherein the dissimilar molten streams merge outside of the spinneret, as opposed to inside the spinneret as is conventional in spinning of conjugate filaments.

NON-SPLITTING FILAMENTS

The above process may be modified to produce filaments of an entirely different character by modifying the spinneret combined orifices such that the molten polymer sub-streams merge prior to extrusion, instead of after extrusion as above.

Figure 8:
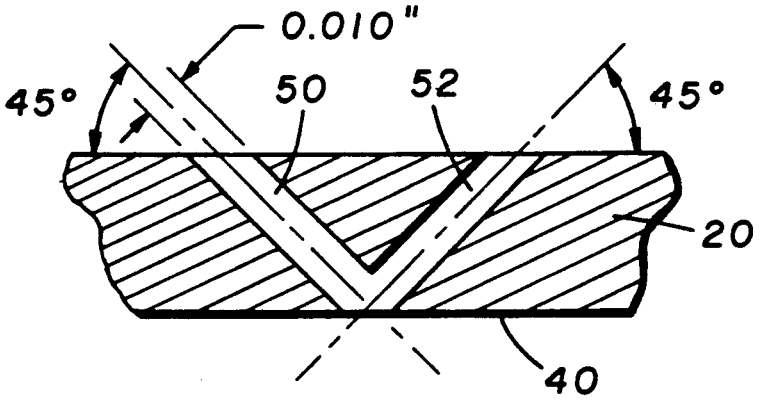
FIG. 8 is a vertical sectional view of a preferred spinneret usable for producing a filament which is not readily splittable.
Figure 9:
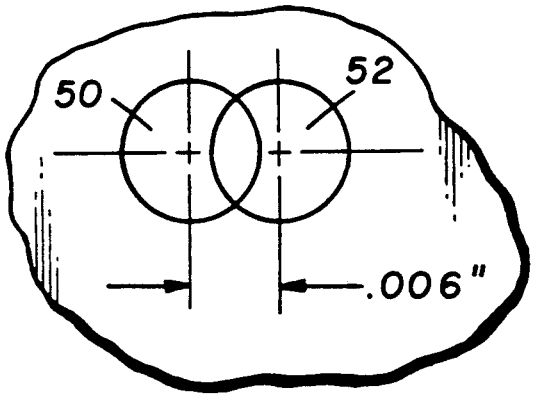
FIG. 9 is a bottom plan view of the FIG. 8 spinneret.
Figure 10:
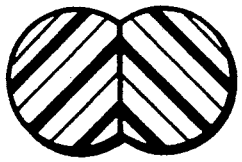
FIG. 10 is a sectional view of a conjugate filament spun from the FIG. 8 spinneret.

Referring to FIGS. 8–10, the spinneret orifice design is constructed to merge molten streams of two dissimilar polymers side-by-side as a combined stream before extrusion from face 40 of spinneret 20. In the preferred design, capillaries 50 and 52 each have diameters of 0.254 mm, and converge within the spinneret to form an included angle of 90°. Capillaries 50 and 52 together constitute a combined orifice for spinning a single combined stream, with a first polymer metered through capillary 50 and a second polymer metered through capillary 52. In practice, the spinneret would include a number of combined orifices, one for each filament. Referring again to FIG. 1, each stream 22 is a combined stream of the type described in this paragraph.

According to this aspect of the invention, the side-by-side conjugate filament is spun at a speed greater than 2200 MPM, the spinning speed being selected such that the filament has a shrinkage greater than 10%. Under these conditions, the constituent sub-filaments have substantially different shrinkages and the filament will have latent helical crimp.

Referring again to FIG. 1, it is preferred that godet 32 be driven at a higher speed than godet 30 so that yarn 28 is drawn prior to winding. This drawing increases the dye-fastness of the nylon 66 component to disperse dyes and generally increases the crimp level in the yarn. Preferably the drawing is sufficient to reduce the yarn elongation to below 75%, with best results achieved when the yarn elongation is reduced to below 50%.

EXAMPLE IV

Using the above disclosed apparatus, 60% by volume nylon 66 polymer and 40% by volume PET polymer of normal molecular weights for apparel end uses are metered through capillaries 50 and 52 respectively at a temperature of 280° C. to provide a filament denier of 4.7. The speed of both godets is 4000 MPM, and the yarn is wound at a winding tension of 0.1 grams per denier. The yarn has an elongation of 74%, good latent crimp, and dyes more deeply than prior art conjugate yarns which have been textured by the false-twist method.

The process of the preceding paragraph is repeated except that the speed of godet 32 is increased to 4500 MPM so as to apply an in-line draw to the yarn. The dye-fastness of the nylon 66 component to disperse dyes is substantially increased, and the yarn continues to dye deeper than prior art yarns which have been hot drawn or textured by the false-twist method. The latent crimp in the yarn is also increased by the step of drawing immediately after quenching and before winding. By selection of the speeds of godets 30 and 32 (and hence the draw ratio), the yarn elongation may be reduced to the preferred level of below 75%, and to the particularly preferred level of below 50%.

If the spinning speed is so high that the PET shrinkage (and hence the yarn shrinkage) were below the level required for satisfactory yarn crimp, application of the in-line cold draw will increase the PET shrinkage and thus improve the crimp level.

EXAMPLE V

A spinneret containing 17 combined orifices of the FIG. 3 type as disclosed above in example IV is provided, and the polymer metering pumps are adjusted to provide equal volumes of the two polymers and a yarn denier of 70. The speed of godet 32 is set to 5000 MPM, and the winder is adjusted to provide a winding tension of about 0.1 gram per denier. The speed of godet 30 is adjusted with resulting yarn shrinkages as set forth in Table 3.

TABLE 3

| Item | Godet 30, MPM | Elongation, % | Shrinkage, % |
|---|---|---|---|
| 1 | 5000 | 68 | 4.8 |
| 2 | 4545 | 58 | 6.8 |
| 3 | 4167 | 53 | 12.2 |
| 4 | 3846 | 42 | 23.3 |
| 5 | 3571 | 39 | 32.8 |
| 6 | 3333 | 38 | 38.0 |
| 7 | 3125 | 36 | 41.2 |
| 8 | 2941 | 37 | 42.6 |
| 9 | 2778 | 35 | 45.5 |
| 10 | 2632 | 33 | 44.4 |
| 11 | 2500 | 30 | 42.0 |
| 12 | 2381 | 30 | 40.9 |
| 13 | 2273 | 30 | 38.4 |

Fabric covering power improves as yarn shrinkage increases. Fabrics formed from Items 1 and 2 in Table 3 have poor covering power, with items 3–9 showing progressive improvement not only in covering power but in fabric stability. Fabric covering power then decreases slightly in progressing from items 10–13.

Each of these yarns dyes substantially deeper than yarns made according to the prior art hot drawing processes, such as Tanner U.S. Pat. No. 3,117,906.

TEST METHOD

Yarn shrinkage is determined by the following method. The bobbin is conditioned at 21° C. and 65% relative humidity for one day prior to testing. 100 meters of surface yarn are stripped off and discarded. Using a Suter denier reel or equivalent, the yarn is wound to form a skein having about 18,000 skein denier. That is, the denier reel revolutions are 9000 divided by the yarn denier. The skein yarn ends are tied together. The skein is suspended from a rod having a diameter of one centimeter and a 1000 gram weight is attached to the bottom of the skein. After 30 seconds, the skein length is measured to provide length L1. The 1000 gram weight is then replaced by a 50 gram weight, whereupon the rod with skein and 50 gram weight are placed in a vigorously boiling water bath sufficiently deep that the skein is under tension from the 50 gram weight. After 10 minutes in the boiling water bath, the rod with skein and the 50 gram weight are removed from the bath and hung up for three minutes to permit excess water to drain off. The rod with skein and suspended 50 gram weight are then placed in a 120° C. oven for 15 minutes, after which the rod with skein and suspended 50 gram weight are removed from the oven and hung for 15 minutes at room temperature. The suspended 50 gram weight is then removed and replaced by a 1000 gram weight. After 30 seconds, the skein length is measured to provide L2. The % shrinkage is defined as 100(L1−L2) divided by L1.

By "incompatible polymers" is meant that the polymers are chemically dissimilar, as in the exemplified polyester and nylon.

What is claimed is:

1. A process for melt-spinning an easily splittable deep-dyeing substantially constant denier conjugate filament from first and second incompatible polymers, said filament being self-texturing in fabric form, comprising:

a. generating a first molten sub-stream of said first polymer and a second molten sub-stream of said second polymer converging at substantially the same speed to merge side-by-side as a combined stream below the face of a spinneret;

b. quenching said combined stream to form a conjugate filament comprising a first sub-filament of said first polymer lightly conjugated side-by-side with a second sub-filament of said second polymer;

c. withdrawing said filament from said combined stream at a predetermined spinning speed; and d. winding said filament at a given winding speed on a bobbin;

e. said polymers and said spinning speed being selected such that said filament splits substantially completely into said sub-filaments upon exposure to boiling water while under no tension.

2. The process defined in claim 1, wherein said spinning speed is selected such that said filament has a shrinkage of at least 10%.

3. The process defined in claim 1, wherein said spinning speed is selected such that said filament has a shrinkage of at least 20%.

4. The process defined in claim 1, wherein said first sub-stream is a polyamide and said second sub-stream is a polyester.

5. The process defined in claim 4, wherein said first sub-stream is nylon 66 and said second sub-stream is poly(ethylene terephthalate).

6. The process defined in claim 5, wherein said spinning speed is at least 2200 MPM.

7. The process defined in claim 6, wherein said filament is drawn at a temperature below 100 C. prior to being wound on said bobbin.

8. The process defined in claim 7, wherein the amount by which said filament is drawn is selected such that said filament has a shrinkage greater than 10%.

9. The process defined in claim 7, wherein the amount by which said filament is drawn is selected such that said filament has a shrinkage greater than 20%.

10. The process defined in claim 7, wherein said winding speed and the amount by which said filament is drawn are selected such that said filament wound on said bobbin has an elongaton less than 70%.

11. The process defined in claim 7, wherein said winding speed and the amount by which said filament is drawn are selected such that said filament wound on said bobbin has an elongation less than 50%.

12. A process for melt-spinning an easily splittable conjugate deep-dyeing variable denier filament from first and second incompatible polymers, said filament being self-texturing in fabric form, comprising:

a. generating a first molten sub-stream of said first polymer and a second molten sub-stream of said second polymer converging at substantially different speeds to merge side-by-side as a combined stream below the face of a spinneret whereby an oscillation of said sub-streams occurs just below the face of said spinneret;

b. quenching said combined stream to form a conjugate filament comprising a first sub-filament of said first polymer lightly conjugated side-by-side with a second sub-filament of said second polymer;

c. withdrawing said filament from said combined stream at a predetermined spinning speed; and d. winding said filament at a given winding speed on a bobbin;

e. said polymers and said spinning speed being selected such that said filament splits substantially completely into said sub-filaments upon exposure to boiling water while under no tension.

13. The process defined in claim 12, wherein said spinning speed is selected such that said filament has a shrinkage of at least 10%.

14. The process defined in claim 12, wherein said spinning speed is selected such that said filament has a shrinkage of at least 20%.

15. The process defined in claim 12, wherein said first sub-stream is a polyamide and said second sub-stream is a polyester.

16. The process defined in claim 15, wherein said first sub-stream is nylon 66 and said second sub-stream is poly(ethylene terephthalate).

17. The process defined in claim 16, wherein said spinning speed is at least 2200 MPM.

18. The process defined in claim 17, wherein said filament is drawn at a temperature less than 100° C. prior to being wound on said bobbin.

19. The process defined in claim 18, wherein the amount by which said filament is drawn is selected such that said filament has a shrinkage greater than 10%.

20. The process defined in claim 18, wherein the amount by which said filament is drawn is selected such that said filament has a shrinkage greater than 20%.

21. The process defined in claim 18, wherein said winding speed and the amount by which said filament is drawn are selected such that said filament wound on said bobbin has an elongation less than 70%.

22. The process defined in claim 18, wherein said winding speed and the amount by which said filament is drawn are selected such that said filament wound on said bobbin has an elongation less than 50%.

* * * * *